US008353123B2

(12) United States Patent
Pullicar et al.

(10) Patent No.: US 8,353,123 B2
(45) **Date of Patent: *Jan. 15, 2013**

(54) SHOTGUN FOREARM-STOCK SHOT SHELL CARRIER WITH HIDDEN RAIL

(75) Inventors: Reme A. Pullicar, Boise, ID (US); James K. Bentley, Paso Robles, CA (US)

(73) Assignee: Krow Innovation, LLC, Nampa, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/109,893

(22) Filed: May 17, 2011

(65) Prior Publication Data

US 2011/0225864 A1 Sep. 22, 2011

Related U.S. Application Data

(63) Continuation-in-part of application No. 11/602,544, filed on Nov. 20, 2006, now Pat. No. 8,122,635.

(60) Provisional application No. 60/597,271, filed on Nov. 19, 2005.

(51) Int. Cl.
*F41C 23/00* (2006.01)

(52) U.S. Cl. ..... 42/72; 42/71.01; 42/85; 42/96

(58) Field of Classification Search ..... 42/72, 85, 42/96, 71.01

See application file for complete search history.

(56) References Cited

U.S. PATENT DOCUMENTS 4,494,332 A 1/1985 Matievich
4,502,238 A 3/1985 Farrar et al.
4,509,284 A 4/1985 Naber
4,756,110 A 7/1988 Beltron
4,850,127 A 7/1989 Davis et al.
4,953,316 A 9/1990 Litton et al.
5,054,221 A 10/1991 Ozols
5,068,992 A 12/1991 Velezis et al.
5,119,575 A * 6/1992 Gajdica ..... 42/19
5,225,613 A 7/1993 Claridge
5,452,533 A 9/1995 Bentley et al.
5,813,157 A 9/1998 Scott et al.
6,032,395 A 3/2000 Bentley et al.
6,185,853 B1 2/2001 Sniezak et al.
6,253,481 B1 7/2001 Melby
6,655,069 B2 12/2003 Kim
6,817,135 B1 11/2004 Jackson
6,952,896 B2 10/2005 Davis
7,954,270 B2 * 6/2011 Bentley ..... 42/71.01
2004/0020093 A1 2/2004 Hajjar et al.
2005/0183315 A1 8/2005 Davis
2005/0241204 A1 11/2005 Hajjar et al.
2006/0010752 A1 1/2006 Rogers
(Continued)

*Primary Examiner* — Daniel Troy
(74) *Attorney, Agent, or Firm* — Parsons Behle & Latimer

(57) ABSTRACT

A forearm stock for a shotgun includes a forearm stock main body, an integral shot shell carrier tube, disposed in the main body, an accessory rail, at the forward end of the main body, and a removable cover, adapted to cover the accessory rail. The forearm stock main body has a forward end, a back end, a contour, and an upper cavity for receiving a shotgun's tube magazine. The shot shell carrier tube is disposed below the upper cavity, and is adapted to receive a plurality of shot shells, with an opening toward the back end. A mechanism for urging the shot shells out of the carrier tube through the opening is provided, and a retention mechanism is adapted to selectively retain the shot shells in the carrier tube. The removable cover has a contour that substantially complements a contour of the main body.

14 Claims, 11 Drawing Sheets

U.S. PATENT DOCUMENTS

2006/0037227 A1 2/2006 Bredeson
2006/0048429 A1 3/2006 Crandall et al.
2006/0048430 A1 3/2006 Crandall et al.
2007/0062090 A1* 3/2007 Brindle ..... 42/96
2007/0137087 A1* 6/2007 Florea et al. ..... 42/90
2012/0085013 A1* 4/2012 Cahill ..... 42/96

* cited by examiner

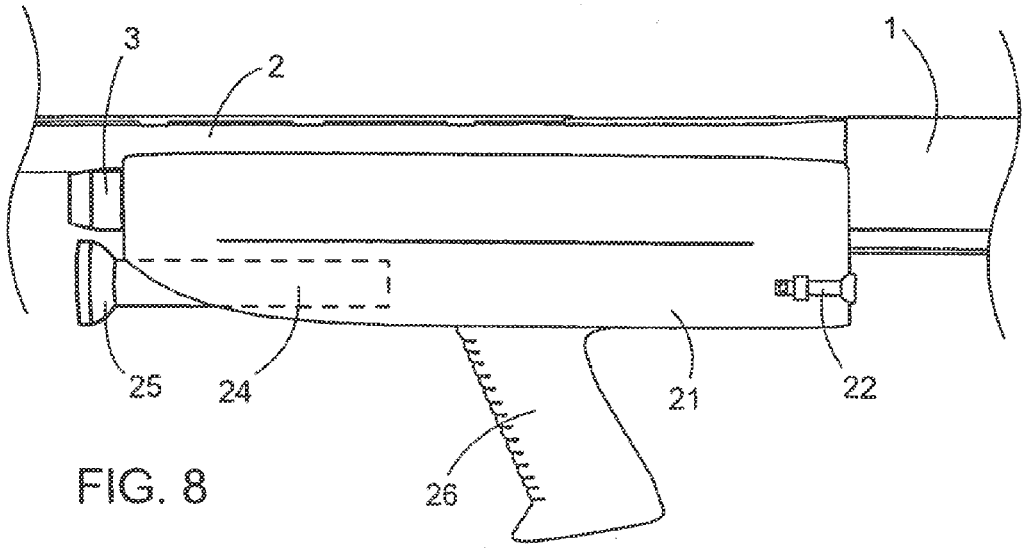
FIG. 8
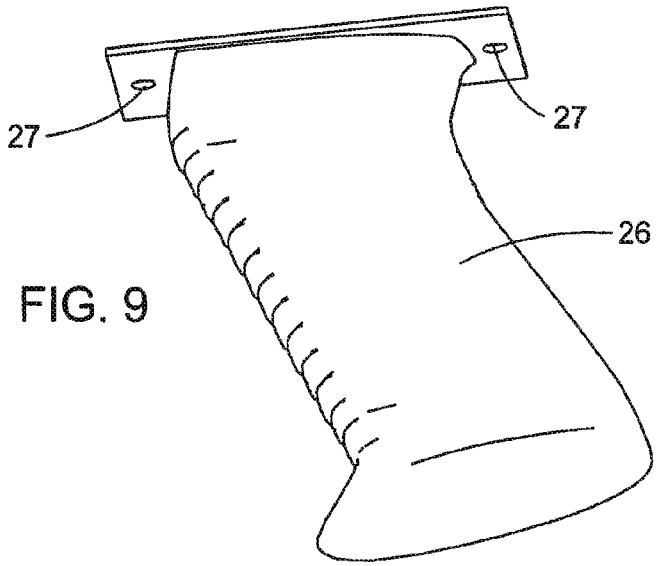
FIG. 9
FIG. 10
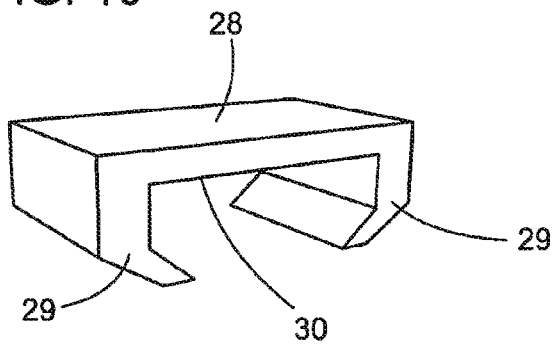

SHOTGUN FOREARM-STOCK SHOT SHELL CARRIER WITH HIDDEN RAIL

PRIORITY CLAIM

This application is a continuation-in-part of U.S. patent application Ser. No. 11/602,544, filed Nov. 20, 2006, now U.S. Pat. No. 8,122,635 which claims priority from U.S. Provisional Patent Application No. 60/597,271, filed Nov. 19, 2005, both entitled "Shotgun Forearm-Stock Shot Shell Carrier," the disclosures of which are incorporated herein by reference in their entireties.

BACKGROUND

1. Field of the Invention

The present invention relates to shotguns and, in particular, to shotguns that can be rapidly loaded with ammunition.

2. Related Art

Under many circumstances it is necessary or desirable to rapidly load and fire rounds of ammunition from a shotgun. The ability to rapidly reload a shotgun for subsequent firing is often key to the firearm's effectiveness. For example, in police work and military applications, it is often necessary, for the user's survival, to be able to rapidly load a shotgun between firing rounds. In some sporting events, such as practical shotgun shooting and sporting clays, the ability to rapidly reload and fire a shotgun with selected load types is also very desirable. Although rapid firing and reloading capabilities have been achieved with some firearms, such as semi-automatic rifles and pistols, they have not yet been satisfactorily achieved with shotguns.

Known shotguns, such as pump-action and semi-automatic, gas-operated, blowback-designed shotguns, typically have a fixed, tubular-shaped magazine mounted below and parallel to the barrel, wherein the shot shells are loaded individually into the magazine. A fixed magazine typically holds as few as three and as many as eight shotgun shells. After all of the shells are fired, the next round of shells are loaded one at a time into the fixed magazine. The process is both time-consuming and complicated, essentially rendering shotguns an impractical alternative to other firearms in many situations where speed loading or the use of differing load types is critical.

The fundamental need to carry and load shotgun shells has been addressed in various ways, including external Shot shell carriers that may attach to the butt stock or receiver group of the shotgun, clothing or belts that accept shot shells in friction-fit elastic material, and external speed loaders that must be carried separately and fitted to the shot gun temporarily during the loading process. Scott, et al. (U.S. Pat. No. 5,813,157) disclose a butt stock shell holder, wherein the butt stock is hollow/apertured to hold multiple shells with their lengths transverse to the length of the butt stock. Naber (U.S. Pat. No. 4,509,284), Beltron (U.S. Pat. No. 4,756,110), and Sniezak, et al. (U.S. Pat. No. 6,185,853) each disclose speedloaders. Bentley, et al. (U.S. Pat. Nos. 5,452,533 and 6,032,395) disclose drum-style magazines that may be attached and removed from the magazine aperture at the bottom of a shotgun receiver, which magazines hold multiple shells in a circular configuration wherein the shells advance in a circumferential path into the receiver. Melby (U.S. Pat. No. 6,253,481) discloses an L-shaped shell holder that attaches to the forward end of a shotgun magazine to hold an extra shell. Each of these options involves certain problems, including low capacity, loss of speed due to the amount of friction required in the shell holder to retain shot shells during firing and recoil or during user movement, and/or the additional weight, bulk, and complexity related to non-attached speed loader solutions.

It is an object of the present invention, therefore, to overcome the problems associated with trying to rapidly load rounds of ammunition into a shotgun, and the disadvantages associated with prior attempts to overcome said problems.

SUMMARY

It is the object of the present invention to provide a means to store, hand retrieve and load shot gun shells into a host shot gun comprising a barrel for firing shells there-through. The host shotgun may be either of a semi-automatic or pump action having a tubular magazine for storing and loading shot shells into its firing chamber. The present invention comprises a shotgun forearm stock that incorporates one or more shot shell storage tubes that will each receive therein a plurality of shells in an end-to-end relationship. The storage tubes are fitted with an internal spring and an external retention mechanism such that shot shells fed into the tubes are retained therein by the retention mechanism, while having pressure applied to the series of shot shells by the spring, such that a shell will be quickly ejected upon displacement of the retaining mechanism. Once one or more of the shells in the storage tube have been ejected, the tube may be refilled.

In a single tube version of the present invention, the novel forearm stock will provide increased capacity to the user while maintaining a smaller grip size as might be required by a user with smaller hands.

A twin or multiple tube version of the present invention will present a larger forearm stock that will provide a substantially increased capacity to the user while also increasing the overall grip size. Multi-tube versions of the present invention preferably comprise retaining mechanisms having differing colors such that the user can associate specific load types to each specific shot shell storage tube.

A pistol grip version of the present invention further comprises a removable pistol grip attached, by a secure but temporary means, to the lower area of the invented forearm stock such that the user may customize the length or reach required to use the pistol grip by attaching said pistol grip to an appropriate bolt hole or holes, for example.

An accessory rail version of the present invention further comprises a mountable rail coupled to or formed on the foremost, bottom area of the forearm stock such that accessory lights, lasers, and other devices may be attached for use with the shotgun. Alternatively, a recess, cavity, or other means of mounting accessories such as lights, lasers, or other devices, may be used, for example, to provide an integral, permanent or semi-permanent, accessory feature.

In another embodiment, the forearm stock includes an accessory rail, at the forward end of the main body, and a removable cover, adapted to cover the accessory rail. The cover can have a contour that substantially complements a contour of the main body of the forearm stock. In one embodiment, the cap is removably attachable to the forearm stock by sliding upon the accessory rail, and can be secured in place with a set screw.

One advantage of the embodiments and methods disclosed herein is that additional shot shell capacity in the form of storage tubes is integrated into the forearm stock, and the shell outlet from said tubes is in extremely close proximity to the host shotgun's magazine and shot shell load ramp. This location of the tubes and the proximity to the magazine and load ramp results in far greater speed, accuracy, and control of the shotgun during reloading. A user may maintain a preloaded shotgun magazine and pre-filled shot shell tubes on the shotgun itself. After one or more shots have been fired, the user can quickly and accurately select shot types from an appropriate shot shell tube and efficiently manually reload the shotgun magazine as needed. The shell outlet location of each shot shell tube is at or very near the rear end of the forearm stock and very near the receiver and the loading ramp into the shot gun magazine. This way, the user need only move a hand a few inches from the forearm stock, after he/she has fired the shotgun, to displace or "unlatch" the retention mechanism, after which a shell is pushed out in a direction parallel to the magazine, preferably into the user's hand. Then, again, the user need only move his/her hand a few more inches, at most, to insert the shell into the loading ramp to load the shell into the magazine. This sequence of steps may easily be repeated several times, to quickly and manually reload the magazine with shells stored only a few inches away in the invented carrier. The host shotgun can therefore be rapidly reloaded between rounds and does not have to be reloaded with the difficulty and excess complexity associated with most prior art shot shell storage and loading solutions.

Other advantages of the embodiments disclosed herein will become apparent in view of the following detailed description and drawings taken in connection therewith. Preferred embodiments therefore comprise the apparatus and systems, together with their parts, elements, and interrelationships, that are exemplified in the following disclosure, while the broad scope of the invention is indicated in the appended claims.

BRIEF DESCRIPTION OF THE DRAWINGS

A fuller understanding of the nature and objects of preferred embodiments of the present invention will become apparent upon consideration of the following detailed description, taken in connection with the accompanying drawings, wherein:

FIG. 5B features the shells removed and springs extended. Note that, in preferred two-tube embodiments, a vertical cross-section along a single plane through the axis of the magazine cavity will extend between the two shell tubes (rather than through either of them) and, in preferred single-tube embodiments, a vertical cross-section along a single plane through the axis of the magazine cavity will pass through the magazine cavity and also through the single tube cavity.

FIG. 8 is a side view of yet another embodiment of a shotgun forearm-stock shot shell carrier, incorporating one embodiment of an accessory light or laser in a formed cavity of main body and one embodiment of a bolt-on pistol grip.

FIG. 9 is a bottom perspective view of the pistol grip of FIG. 8.

FIG. 10 is a perspective view of a one embodiment of a shot shell retention mechanism's retention clip.

DETAILED DESCRIPTION

Figure 1:
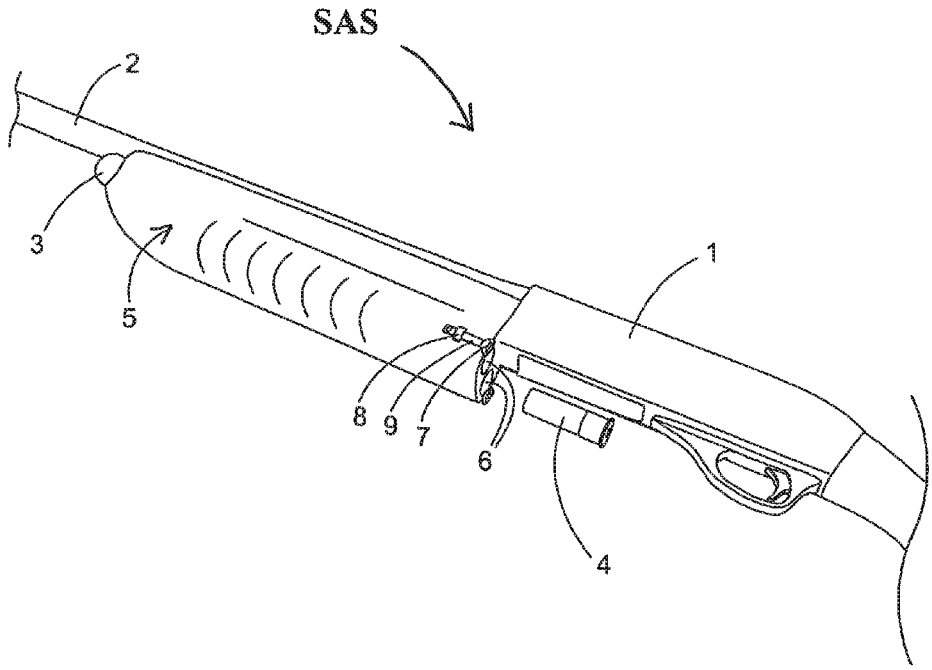
FIG. 1 is a perspective view of one embodiment of the invented shotgun forearm-stock shot shell carrier, in a fixed position on a semi-automatic shotgun.

Referring now to the drawings, there are shown several, but not the only, embodiments of the invented shotgun forearm-stock shot shell carrier. The embodiments disclosed herein provide a forearm stock with integral shell carrier tubes, and the invented forearm stock with said carrier tubes replaces the conventional forearm-stock of the shotgun. The preferred forearm stock with said carrier tubes provides a structure that provides both a grip for holding the shotgun during transport or firing and the storing of additional shot shells until needed by the user. The structure for connecting to the magazine of the shotgun, the structure for use as a grip, and the structure for carrying extra shotgun shells is preferably all part of a single, integral unit.

The preferred forearm-stock shell carrier slides onto the magazine of the shotgun, in the place of the conventional forearm-stock, for example, by means of the threaded end of the magazine being removed to allow said sliding-on of the carrier and then said threaded end being replaced to retain the carrier on the magazine. The preferred forearm-stock shell carrier extends along substantially the entire shotgun magazine (along at least 70 percent of the length of the magazine and, most preferably, along at least 90 percent of the magazine). The preferred forearm-stock shell carrier is elongated and has a thickness from top to bottom (vertical dimension when the shotgun is in normal firing use) and a width from side to side (horizontal dimension when the shotgun is in normal firing use) that are large enough to accommodate at least one shell tube but that are within a range for comfortable grasping and operation by the user. Thus, while the invented forearm-stock shell carrier has the added features and functionality of carrying multiple shells (preferably 4-8 shells), it is still operable and comfortable for traditional forearm-stock functions of gripping and supporting the gun during travel and use, and of pumping action in the case of pump shotguns. Preferably, the forearm-stock shell carrier does not attach to the forward end of the magazine, but rather slides over the forward end of the magazine during installation to be against or very near the receiver. The preferred versions reside in the entire or substantially the entire space and length along the magazine in which the conventional, original forearm-stock would reside, and may still be said to be generally elongated and parallel to the magazine. The shell tubes are parallel to the magazine and are horizontal or very nearly horizontal when the firearm is being shot.

The embodiments disclosed herein may be provided as a retrofit "forearm-stock with carrier" system that replaces the original equipment manufacturer (OEM) forearm stock, or may be supplied as OEM equipment with the shotgun at the point of sale. Referring now to the Figures:

In FIG. 1, the forearm stock shot shell carrier 5 is presented in one embodiment as having been attached to a semi-automatic shotgun SAS, such that the forearm stock shot shell carrier substantially envelopes and engages the shotgun tube magazine 3, preferably so that the carrier 5 is in a fixed position relative to the magazine 3 and to the rest of the shotgun SAS, and is close to the receiver 1.

In FIG. 1, the shot shell speed carrier 5 is presented as incorporating the preferred shell retention mechanism, which comprises a spring steel retainment mechanism such that a retention tab 7 (7 A, 78) engages a shot shell 4 by virtue of the spring tension produced by the forward end of spring steel segment 9 being held fast to the main body 5 by a retention clip 8.

Figure 2:
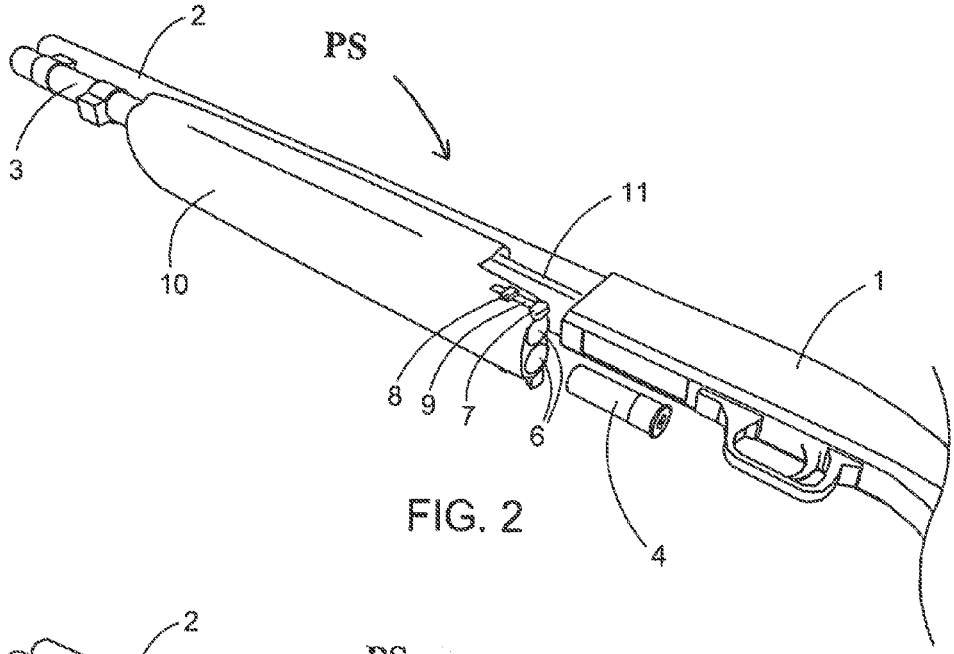
FIG. 2 is a perspective view of another embodiment of a shotgun forearm-stock shot shell carrier, on a pump action shotgun in its forward, shotgun-bolt closed position.

In FIG. 2, the shot shell carrier is presented in another embodiment as having a cutout design such that it can accept and interoperate with the action bars 11 of a pump shotgun PS, while maintaining a close proximity to the shotgun's receiver 1. The forearm shot shell carrier is attached to the pump action shotgun PS with the carrier 10 substantially enveloping and engaging the shotgun tube magazine 3 and the shotgun's action bars 11. The carrier 10 provides a grip for holding the shotgun during transport or firing, a method of grasping and actuating the pump action, and the storing of additional shot shells 4 until needed by the user.

Figure 3:
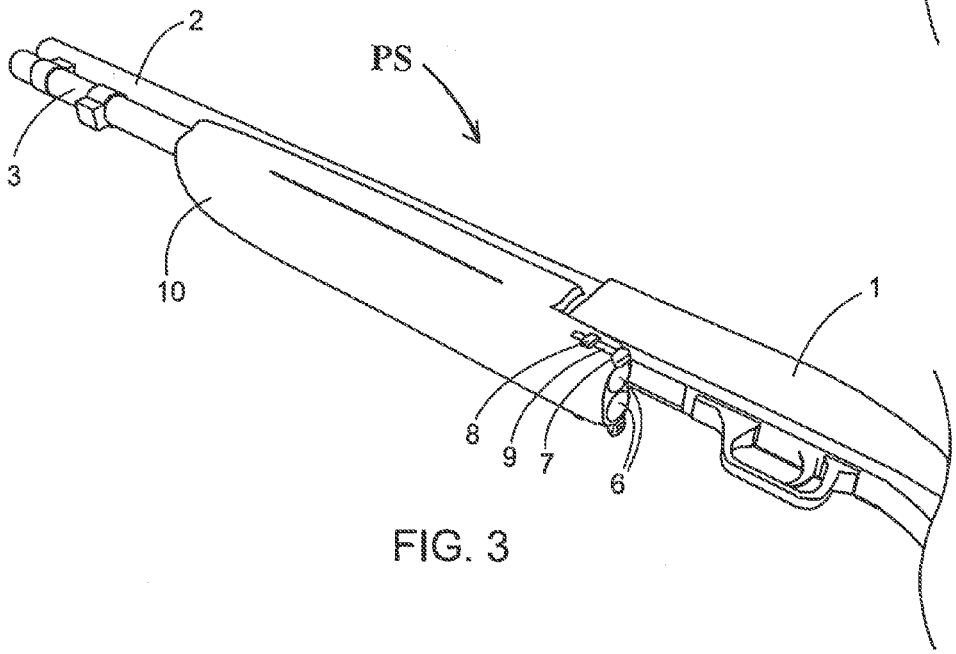
FIG. 3 is a perspective view of the shotgun forearm-stock shot shell carrier of FIG. 2, with the pump action shotgun is in its rearward, shotgun-bolt open position.

In FIG. 3, the forearm-stock shot shell carrier is presented in its most rearward position, such that the receiver 1 of the pump action shotgun is opened~ In this position a shot shell may not be loaded into the shotgun's magazine, but may be loaded into the breach of the shotgun's receiver directly.

Figure 4:
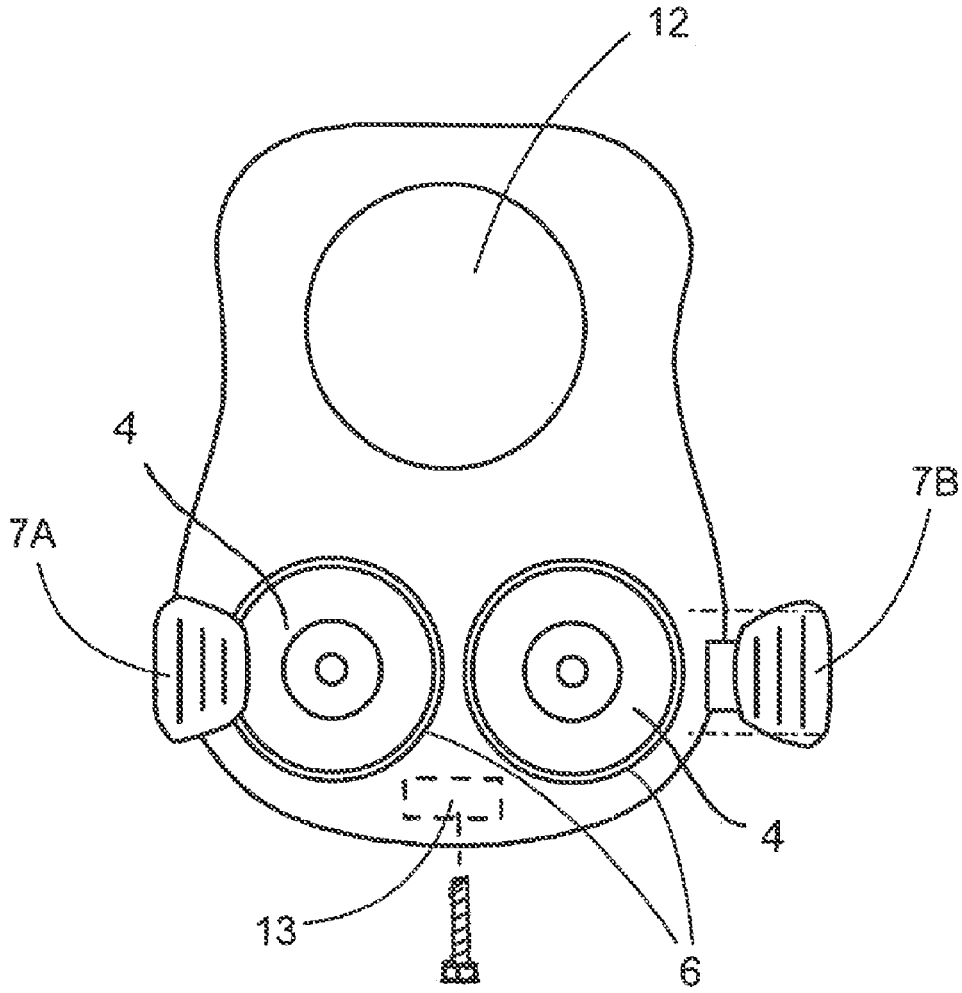
FIG. 4 is an end view of a shotgun forearm-stock shot shell carrier comprising a shot shell retaining mechanism such as is shown in FIG. 1 and FIG. 2, wherein shot shell retaining clips protrude into the shot shell cavities at or near openings into the cavities. In this Figure, tab 7 A is shown in the inwardly-biased retaining position extending partially over a shell, and tab 78 is shown in the outwardly-displaced release position away from the shell. This Figure illustrates most accurately the end view of a semi-automatic shotgun forestock carrier such as in FIG. 1, wherein the forearm stock rearward end surface is generally on a single plane (needing no L-shaped notch or cut-in for extending rearward along the receiver).

In FIG. 4, the forearm-stock shot shell carrier's shotgun tube magazine cavity 12 is embodied in its preferred position such that it is centered over two parallel shot shell cavities 6. Two shot shell retention mechanisms (portions that are called tab 7 A and tab 78) may protrude into the shot shell cavities such that shot shells are retained until needed. One embodiment of a pistol grip attachment bar 13 can be seen in an embedded state within the main body of the forearm-stock shot shell carrier.

In FIG. 4, tab 7 A is shown in the inwardly-biased position engaging an end of one shell and retaining the entire row of shells in that tube inside the carrier. Tab 78 is shown as it would appear when retracted or "disengage" to allow the row of shells in that tube to slide rearward and the rearmost shell to exit the tube. Preferably, the retention mechanism and its tabs 7A, 78 are configured so that the tensioner quickly biases the tab back toward the cavity, after a given shell has exited, in time to stop the next shell from exiting the tube, unless the user continues to hold the tab away from the cavity. This way, this embodiment may dispense one shell at a time without the user having to manually "relatch" or "reengage" the retention mechanism—the retention mechanism is biased to "relatch" itself to automatically reengage the next shell.

Figure 5A:
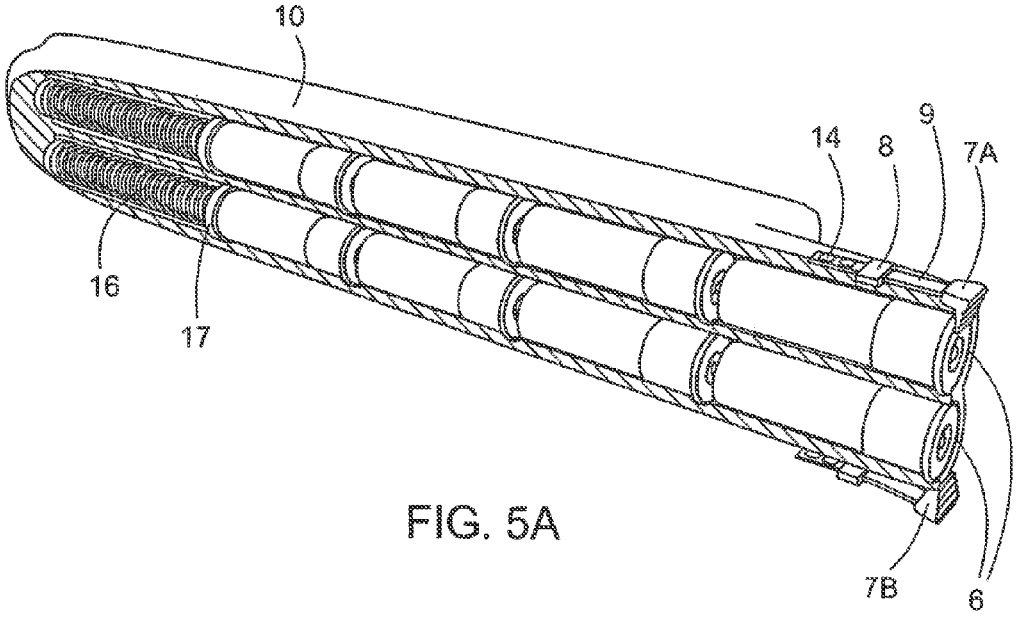
FIG. 5A is a longitudinal cutaway, bottom view of the pump shotgun forearm-stock shot shell :carrier of FIG. 2, showing its interior components and eight shells loaded in the carrier.

In FIG. 5A, forearm-stock shot shell carrier is portrayed with its main body cut in cut-away fashion that reveals both of the shell cavities 6, and two of the preferred systems of pushing shot shells out of the shell cavities 6. The system of pushing shot shells comprises cavity spring 16, and a shot shell follower 17, which urge the shot shells loaded in the carrier longitudinally out of the carrier. Retaining the shells in the carrier against the force of the system of pushing is the shot shell retention mechanism discussed in detail below. Therefore, shot shells inserted into the storage cavity 6 are retained within the cavity by the exerted force of a shot shell retention system until the user disengages the retention system from holding the shells-.:in the carrier.

The preferred retention mechanism comprises a spring steel tensioner 9 for each shell cavity, wherein each tensioner 9 provides a force toward the axis of its respective cavity 6, so that a thumb tab 7A, 7B attached to an end of the tensioner 9 will extend radially toward the axis of the respective cavity, and in doing so, extend across a portion of the opening of the cavity. See tab 7A in FIG. 4, which portrays the position of the tab as it is biased to an inward position interfering with any shell leaving the cavity 6. After a cavity of the carrier is loaded with shells, the tab of that respective cavity interferes with the release of shot shells from the cavity until the tab is manually removed from the shot shell path.

Figure 11:
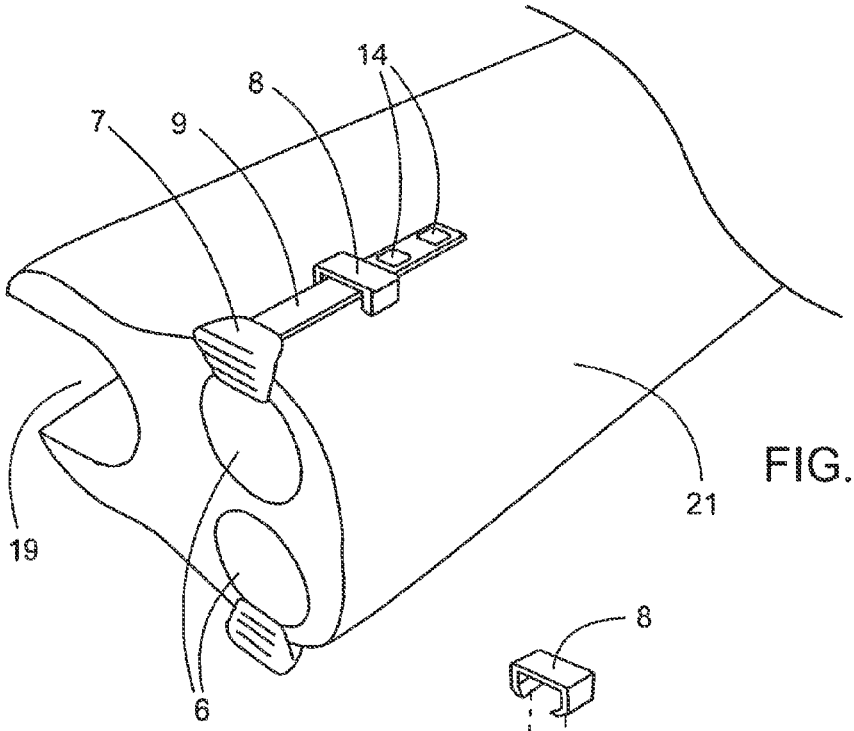
FIG. 11 is a partial view of the embodiment of FIGS. 1,4, and 6B, illustrating to best advantage the shot shell retention mechanism used in FIGS. 1-8.
Figure 12:
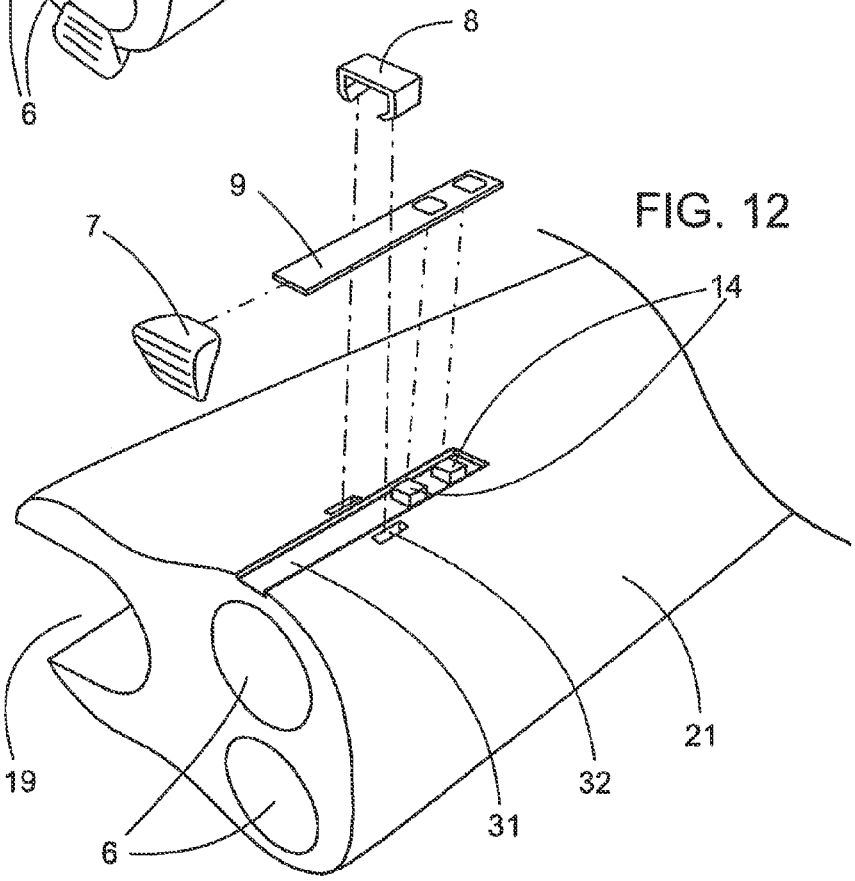
FIG. 12 is a partial view of the embodiment of FIGS. 1,4, 6B, and 11, with the shot shell retention mechanism exploded stock shell carrier in accordance with the present disclosure.

In one embodiment, the spring steel tensioner 9 is attached to the forearm-stock shot shell carrier body 21 by nubbins 14 (which are formed/provided in a slot on the carrier body and which are inserted into holes through the spring steel tensioner) and by a fastener clip 8 that snaps into the carrier body and captures the tensioner 9 between said clip 8 and the body 21. The retention mechanism is illustrated to best advantage in FIGS. 11, 12, and 10 (detail of the clip 8).

Figure 5B:
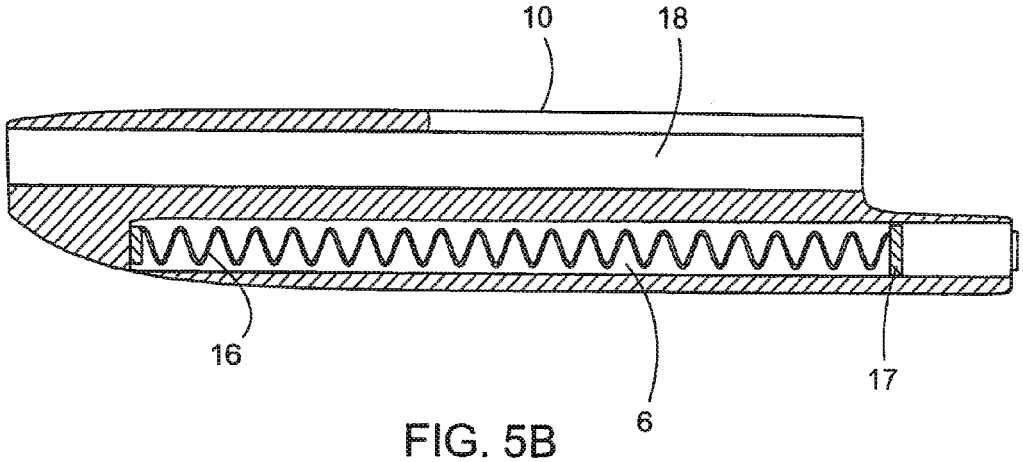
FIG. 5B is a longitudinal cutaway, side view of the shell carrier of FIGS. 2 and 5A, with the cut-away view taken at places that will reveal both the magazine cavity and the shell cavity.

In FIG. 5B, forearm-stock shot shell carrier is portrayed with its main body cut in cut-away fashion that reveals both the magazine cavity 18, only one of the shell cavities 6, and the preferred system of pushing shot shells out of the one shell cavity 6. Note that, in preferred two-tube embodiments, a vertical cross-section along a single plane through the axis of the magazine cavity will extend between the two shell tubes (rather than through either of them) and, in preferred single-tube embodiments, a vertical cross-section along a single plane through the axis of the magazine cavity will pass through the magazine cavity and also through the single tube cavity.

Figure 6A:
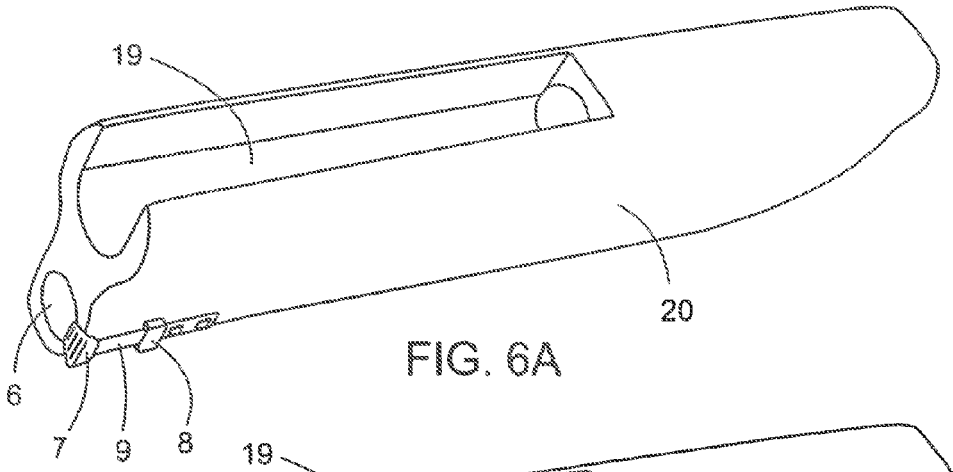
FIG. 6A is a top, rear perspective view of one single-tube embodiment of the invented shotgun forearm-stock shot shell carrier, with the preferred "flat" rear surface of a semiautomatic version.
Figure 6B:
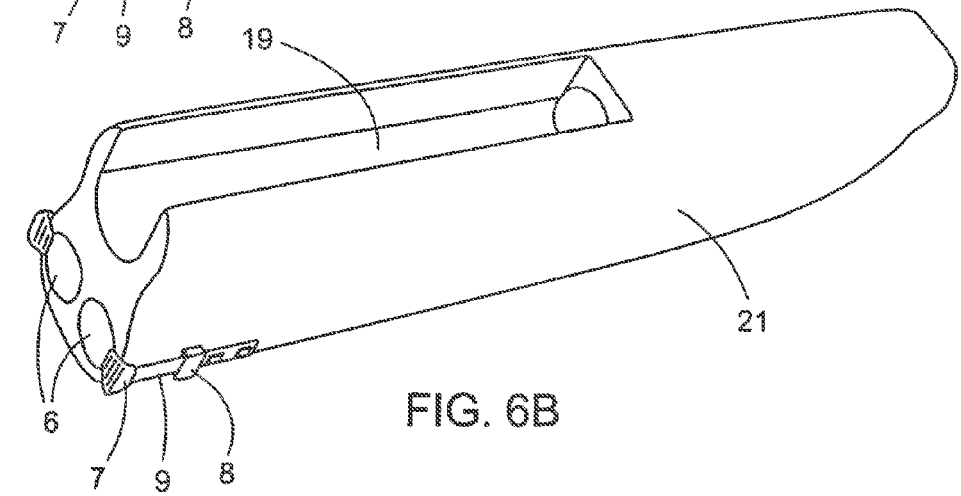
FIG. 6B is a top, rear perspective view of a two tube embodiment such as that shown in FIG. 1.

FIGS. 6A and 6B illustrate the preferred single tube embodiment 20, and double tube embodiment 21, respectively, of the forearm-stock shot shell carrier main body, for use with a semi-automatic shotgun. The single shell storage cavity 6 and the shotgun magazine cavity 19 are aligned so that their longitudinal axes are preferably on a single plane. During typical use of the shotgun, said single plane would be a vertical plane, and the shell cavity 6 would be directly below the magazine cavity 19). Note that cavity 19 is open at its top over a portion of its length and closed over the remaining portion of its length. Thus, because of this option for an open-topped portion of the magazine cavity, and/or because the preferred carriers do not cover or extend in front of the front-most end of the magazine, the carriers may be said to substantially envelope rather than necessarily entirely envelope the magazine.

Figure 7:
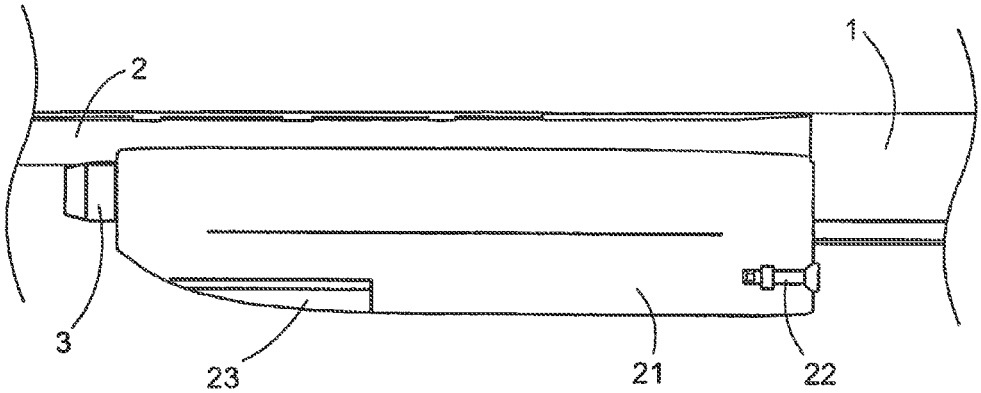
FIG. 7 is a side view of a shotgun forearm-stock shot shell carrier installed on a semiautomatic shotgun, wherein the carrier incorporates one embodiment of an accessory rail on its forward most, bottom surface.

FIG. 7 illustrates one embodiment of an integrated accessory rail 23 formed or otherwise provided in the front, bottom section of the carrier main body 21. This rail 23 receives accessories either for storage until the user wishes to remove and use said accessories or for use in position in or extending from the rail 23. Various accessories may be mounted on said rail 23, such as a light 25, laser, or other accessory for use with the shotgun.

FIG. 8, illustrates one embodiment of an integrated accessory cavity 24 formed or otherwise provided into the front, bottom section of the carrier main body 21. The cavity 24 receives accessories either for storage until the user wishes to remove and use said accessories or for use in position in or extending from the accessory 24. Various accessories may be mounted on said rail 23, such as a light 25, laser, or other accessory for use with the shotgun.

FIGS. 8 and 9 illustrate one embodiment of a pistol grip 26 that may be fixed to the carrier main body 21, for example, by bolts extending into the pistol attachment bar 13. FIG. 9 illustrates attachment holes 27 for bolting the pistol grip 26 to the carrier main body 21 such that the pistol grip and shotgun forearm-stock act as a single unit. The pistol grip 26 may be grasped in a classic pistol grip hand position (generally vertical) instead of said user grasping/holding the main body of the forearm-stock carrier, and, if the carrier and grip assembly 26 is being used on a pump shotgun, the grip assembly 26 may be used as the grip the user used to pump the shotgun.

FIG. 10 provides an enlarged view of the fastener clip 8 of the retention mechanism of FIGS. 1-SA, 6A, 6B, 7 and 8. The clip 8 comprises a preferably flat outer surface 28, two wings 29 (also called "opposing teeth" or "opposing cleats"), and a generally flat inner surface 30. The clip 8 receives the spring steel tensioner 9 in the interior space defined by surface 30 and the wings 29, and said wings 29 snap into apertures in the main body 21 to retain the clip and the captured tensioner 9 in place against the body 21. Once said tensioner 9 is connected to the main body by the clip 8, the forward end (to about the middle) of the tensioner 9 is held against the main body, but the rearward end of the tensioner 9 and its tab 7 is free to resiliently flex. The spring character of the tensioner 9 tends to keep the tensioner 9 and its tab 7 biased inward toward the axis of its respective cavity 6, but it may be manually flexed outward by the user to allow removal of one or more shells. After being released, the tensioner will return to its position wherein the tab extends over a portion of the cavity opening. If the user releases the tensional/tab as a given shell is exiting the cavity, the tensioner/tab will return to the retention position immediately after the shell has exited, and preferably in the split second before a second shell begins to exit. In alternative embodiments, the retention mechanism is adapted to allow multiple shells to exit until deliberate action by the user.

One may see from the drawings and this description, that the embodiments disclosed herein do not automatically or semi-automatically feed or load shells into the loading ramp, magazine, or receiver. The embodiments disclosed herein are intended to make manual loading of said loading ramp, magazine, or receiver quick and more convenient, but are not intended to be adapted to accomplish said loading except by use of the human hand. Therefore, the preferred forearm stock carrier contacts and connects to the outer surface of the magazine tube (and in pump shotguns also will typically operatively connect to the reload or "action" bars) and is near and may contact the receiver, but preferably there is no accommodation for direct loading from the carrier to the magazine or receiver (that is, only indirect loading by the human hand).

Some embodiments of the invention may be described as: A forearm stock for a shotgun having one or more integral shot shell carrier tubes, said forearm stock comprising: a main body, said body having an upper central cavity formed such that it may accept the engagement of a shotgun's tube magazine and reload bar assembly as appropriate to pump action shotguns; and said main body having one or more tubular cavities formed such that they may receive a plurality of shot shells, said tubes having an open end and an opposing closed end, said open end and said closed end being spaced-apart thereby defining a shot shell carrier section there between; and a means of compressing shot shells within the carrier cavity; and a means of safely pushing shot shells within the carrier cavity; and a means of retaining shot shells within the carrier cavity; and a means of releasing shot shells from within the carrier cavity; and optionally, a means of attaching a removable, repositionable, pistol grip to the main body; and optionally, a means of attaching accessory lights, lasers and other accessories to the main body.

Embodiments of the invention may include the combination of: the said main body of said forearm stock carrier being attached to a semi-automatic or pump action shotgun such that the upper central cavity of the main body accepts the magazine tube of either gun type and in the case of a pump shotgun, the action bars of the pump action shotgun. The forearm stock's one or more shot shell carriers provide increased shot shell storage capacity on the host shotgun and in close proximity to the shotgun's magazine, feed ramp, or firing chamber.

In many embodiments, the shell carrier portion of the preferably-integral unit utilizes the tension of one or more internal springs to control shot shell movement within said carrier portion until released by actuation/disengagement of a retention mechanism. Other mechanisms for urging the shells preferably to the rearward end of the carrier tubes may be used, with said mechanisms for urging preferably being automatic and not requiring the user's action to create or to actuate said urging.

The shot shell retention mechanism may be of various designs and attached or operatively connected by various means preferably to the main body. The retention mechanism counteracts the urging by said mechanism for urging, for example, by counteracting tension of said internal springs upon the shot shells. The retention mechanism may be any of various designs that bias a member, or a portion of a member, to extend or otherwise pass at least partially across or at least partially into the pathway of shot shells, in such as way that said member or portion of a member stops, retards, blocks, or frictionally engages the shell to prevent movement and/or exit of the shell(s). The retention mechanism is preferably a spring-loaded member or biased member of any type, for example, the spring steel plate or arm, a rocker arm that is biased to pivot its rearward end across or into the rear opening, or a protrusion of various kinds that pivots, flexes, slides, snaps, or otherwise moves with a radial component of motion across the opening or otherwise into the cavity. Said retention mechanism member or member portion may enter or block the path of the shells rearward of the shell cavity and rearward of the rear opening, at the rear opening, or even forward of the rear opening at any of various locations along the length of the carrier tube(s) (wherein they would protrude, pivot, flex, slide, snap, or otherwise move through an aperture or slot in the main body to reach into the shell cavity. The retention mechanism may be color-coded to provide associable visual reference to shot shell load types stored within the cavities of the carrier portion.

Preferably, if there are multiple carrier tubes, each with its own internal spring and its own retainer, the internal springs operate independently of each other and the retainer operate independently of each other; this way, the user may withdraw shells from one or the other tube independently from the other tube. The retention mechanism may include a length of spring steel or other biasing material, and it may have one or more holes designed to accept nubbin protrusions, screws, or other attachment means, wherein the nubbins or a means of accepting the biasing material may be removably attached. The retention mechanism may also be held in place on the main body by a removable clip. Alternative means of attaching the retention to the main body may be used, for example, tape, screws, clamps, clips, or other fasteners.

Figure 13:
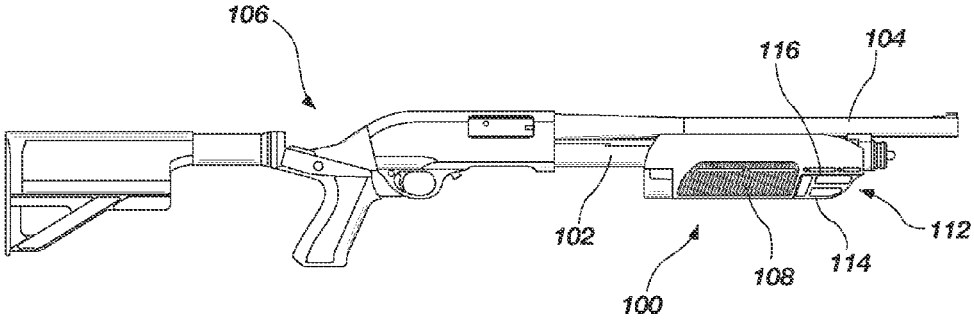
FIG. 13 is a side view of another embodiment of a shotgun provided with another embodiment of a forearm-stock shot shell carrier having a hidden rail.

Another embodiment of a shotgun forearm-stock shot shell carrier is shown in FIGS. 13-18. As shown in FIG. 13, this embodiment of the forearm-stock shot shell carrier 100 comprises a main body that attaches to a tube magazine 102 below a barrel 104 of a shotgun 106, in the manner discussed above. The forearm stock 100 can include ridges 108 for gripping, and can be slidable along the tube magazine 102 for use with a pump-action shotgun. Other configurations that attach directly to the barrel 104 of the gun 106 can also be used.

Figure 14:
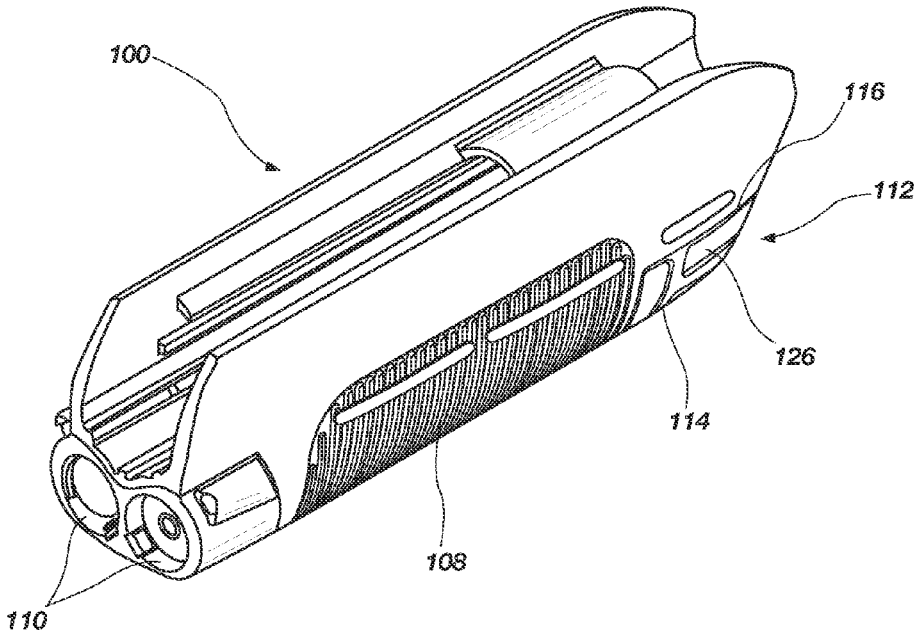
FIG. 14 is a rear perspective view of the forearm-stock shot shell carrier of FIG. 13, removed from the shotgun, and showing the rear openings of the shell carrier tubes.

As can be seen in the rear view of FIG. 14, the forearm-stock 100 can include a shot shell carrier that includes a pair of shot shell carrier tubes 110. As described above, these tubes can include a cavity spring and retention mechanism, allowing shells that are held within the carrier tubes 110 to be selectively discharged near the receiver for loading into the shotgun.

Figure 15:
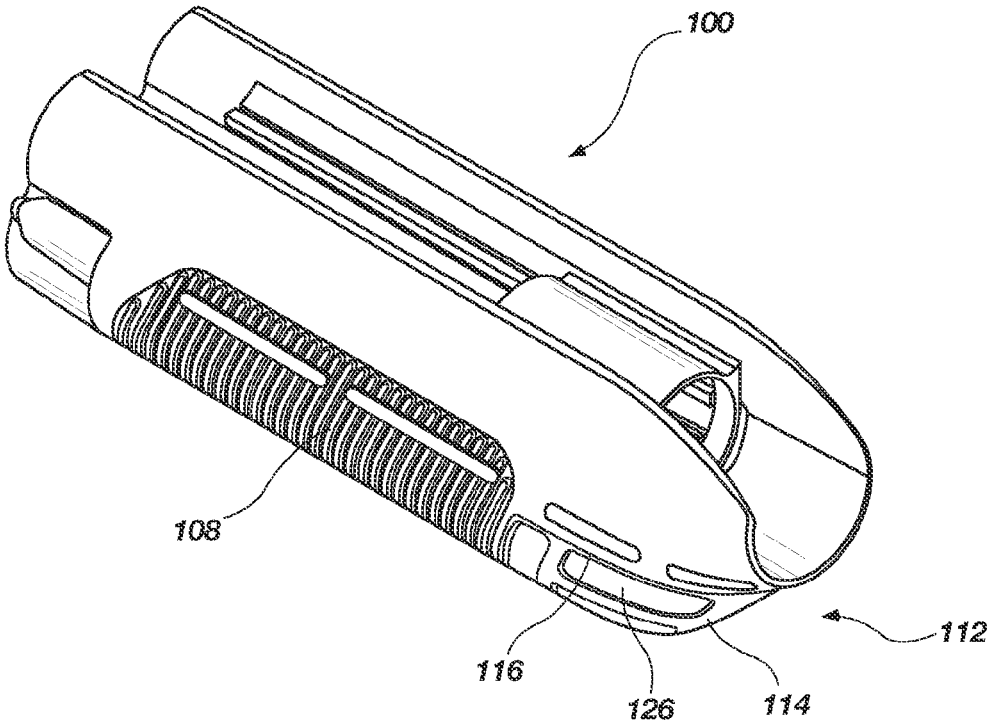
FIG. 15 is a front perspective view of the forearm-stock shot shell carrier of FIG. 13, removed from the shotgun, with the rail cap in place over the hidden rail.
Figure 16:
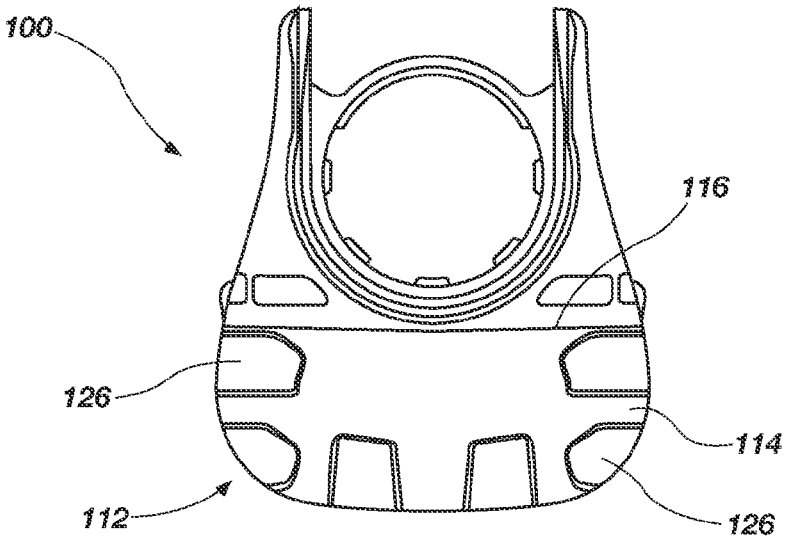
FIG. 16 is a front view of the forearm-stock shot shell carrier of FIG. 15, with the rail cap in place over the hidden rail.

Advantageously, the forearm-stock 100 shown in FIGS. 13-18 includes a hidden rail for attaching accessories, such as accessory lights, lasers, and other devices. As shown in FIGS. 15 and 16, the front 112 of the forearm-stock 100 includes a rail cap or cover 114 that fits in place over a hidden rail, which is not visible in this view. The rail cap can have a contour and appearance that complement the contour and appearance of the main body. For example, the cap can include depressions or contour features 126 that match the main body of the forearm stock. This complementary contour and appearance causes the cap 114 to blend in with the body of the forearm stock 100. That is, the material, shape, texture and color of the rail cap 114 can be the same as that of the forearm stock 100, so that when the cap is in place, the only indication that the cap is removable is a small seam 116 around the perimeter of the cap. Otherwise, the cap simply gives the appearance that it is simply the forward end of the forearm stock. Additionally, the contour features 126 of the cap can also help aid in gripping the cap, which facilitates attachment or removal of the cap. The rail cap can be made of rigid polymer material, or any other material that matches the forearm stock generally.

Figure 17:
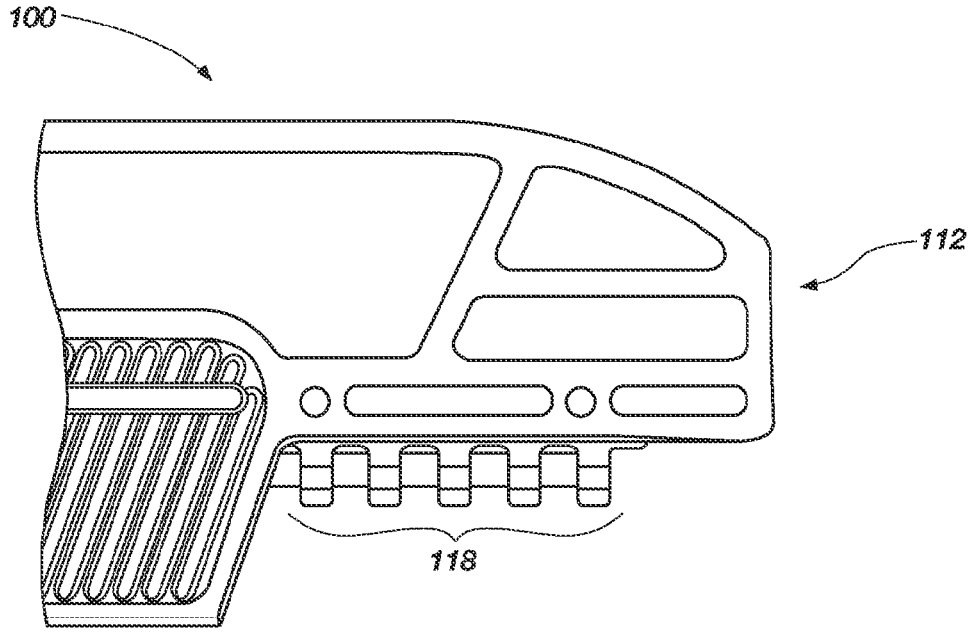
FIG. 17 is a partial side view of the front portion of the forearm-stock shot shell carrier of FIG. 15, with the rail cap removed, showing the hidden rail.
Figure 18:
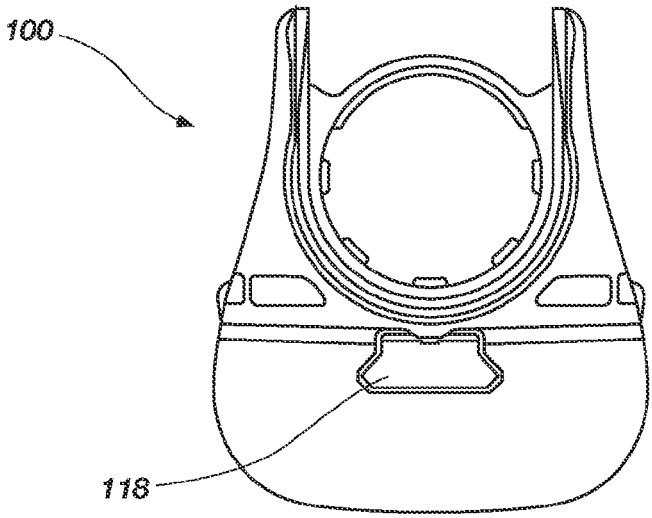
FIG. 18 is a front view of the forearm-stock shot shell carrier of FIG. 15, with the rail cap removed, showing the hidden rail.

Advantageously, the rail cap 114 is removable from the forward end 112 of the forearm stock 100, revealing an accessory rail 118 beneath. Provided in FIG. 17 is a partial side view of the front portion of the forearm-stock 100 of FIG. 15, with the rail cap 114 removed, showing the hidden rail 118. Provided in FIG. 18 is a front view of the same, showing the hidden rail 118. The rail 118 that is covered by the rail cap 114 can be of various types or configurations. For example, the rail can be a picatinny rail, a weaver rail, or a universal rail. The rail is configured to receive accessory lights, lasers, and other devices for use with the shotgun.

Figure 19:
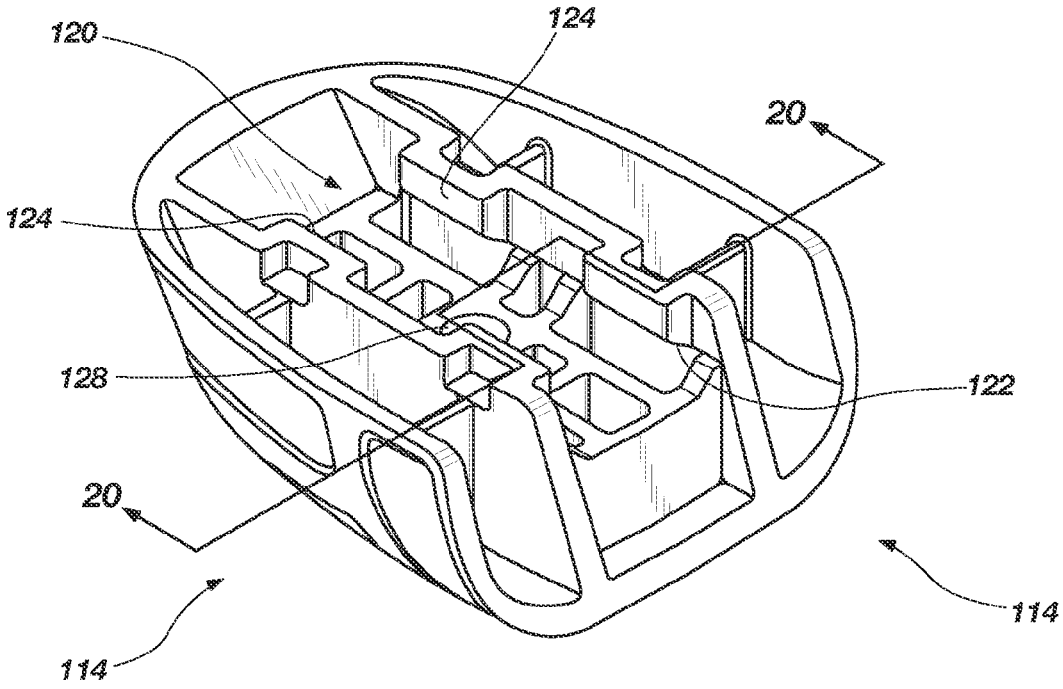
FIG. 19 is a rear perspective view of a embodiment of a rail cap for a forearm-stock with hidden like that of FIG. 15.
Figure 20:
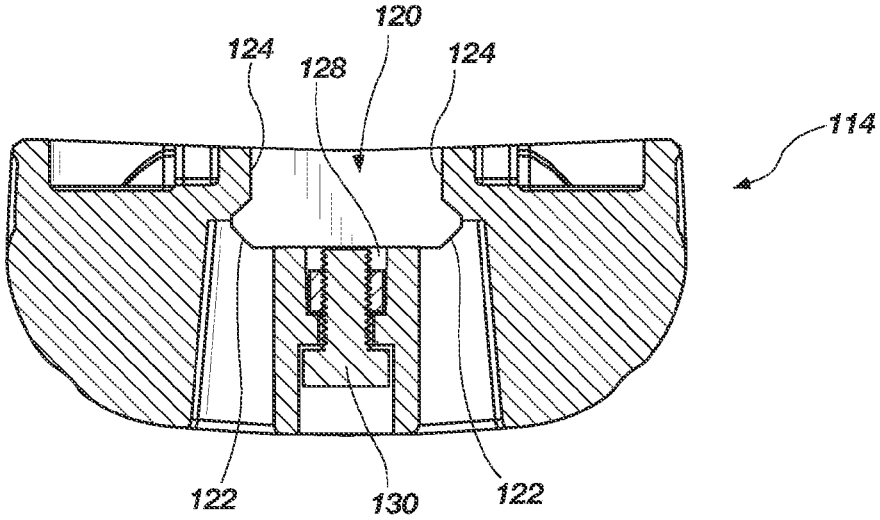
FIG. 20 is a transverse cross-sectional view of the rail cap of FIG. 19, showing the rail-engaging internal structure and the rail cap set screw.

A rear perspective view of one embodiment of a cap 114 that can be used to cover the rail 118 is shown in FIG. 19, and a transverse cross-sectional view of the same is shown in FIG. 20. The cap 114 is designed to slide onto the rail 118 in a manner similar to the way that accessories are attached to the rail. The interior of the cap includes a rail slot 120, defined by lateral side walls 122 and upper support ribs 124 that include angled faces that mate with the corresponding faces of the rail 118. The rail slot provides a longitudinal groove that receives the rail and holds the cap in place against the forearm stock.

The cap 114 also includes a set screw aperture 128 with a set screw 130 that extends up through this aperture from the bottom of the cap. Tightening the set screw 130 pushes the screw against the bottom side of the rail 118, and correspondingly pulls the rail support ribs 124 tightly against the upper surfaces of the rail, thus affixing the cap to the rail in a manner similar to the way that to a tight fit with the rail. This causes the cap 114 to stay securely in place when placed over the rail. It is to be understood that other mechanisms for attaching the cap to the forearm stock and securing the cap can also be used, such as a latch mechanism, a detent mechanism, etc.

To remove the cap 114, a user first loosens the set screw 130, then grips the cap on opposing sides and pulls it forward, causing the cap to slide forward off of the rail 118. As noted above, the cap can include ridges, depressions, or other contour features 126 that make the cap easier to grip by hand. The rail cap thus performs two basic functions. First, it hides the rail when the rail is not in use, which contributes to the aesthetic appearance of the gun and also protects the rail from possible damage. Second, the cap can be easily and quickly swapped for another cap, such as a cap containing a light and power pack, or for other accessories, including after-market accessories, such as lights, lasers, a bipod support, etc.

Although this invention has been described above with reference to particular means, materials and embodiments, it is to be understood that the invention is not limited to these disclosed particulars, but extends instead to all equivalents within the scope of the following claims.

What is claimed is:

1. A forearm stock for a shotgun, comprising:

a forearm stock main body, having a forward end, a back end, a contour, and an upper cavity for receiving a shotgun's tube magazine;

an integral shot shell carrier tube, disposed in the main body below the upper cavity, adapted to receive a plurality of shot shells, and having an opening toward the back end;

a mechanism for urging the shot shells out of the carrier tube through the opening; and a retention mechanism adapted to selectively retain the shot shells in the carrier tube;

an accessory rail, at the forward end of the main body; and a removable cover, adapted to cover the accessory rail.

2. A forearm stock as recited in claim 1, wherein the mechanism for urging comprises a spring to push the shot shells rearward through the carrier tube to the opening.

3. A forearm stock as recited in claim 2, wherein the retention mechanism counteracts the spring to retain the shot shells in the carrier tube until a user manually disengages the retention mechanism.

4. A forearm stock as recited in claim 3, comprising two of the carrier tubes and two of the retention mechanisms, and wherein the retention mechanisms are color-coded to provide associable visual reference to different shot shell load types stored within the two carrier tubes.

5. A forearm stock as recited in claim 3, wherein the retention mechanism comprises a biasing material that biases at least a portion of the retention mechanism to a position over a portion of the open end to interfere with the shot shells exiting the carrier tube through the opening.

6. A forearm stock as recited in claim 1, wherein the accessory rail is selected from the group consisting of a picatinny rail, a weaver rail and a universal rail.

7. A forearm stock as recited in claim 1, further comprising a set screw, adapted to secure the removable cover to the accessory rail.

8. A shotgun, having a barrel, a receiver, an upper cavity for receiving a shotgun tube magazine, a butt stock, and a forearm stock, the forearm stock comprising:

at least one shot shell carrier tube internal to the forearm stock that is separate from the magazine, the shot shell carrier tube being below the upper cavity;

an urging mechanism, adapted to urge shot shells out of the carrier tube through a rear opening;

a retainer, adapted to selectively retain the shot shells in the carrier tube; and an accessory rail, disposed beneath a removable cover at a forward end of the forearm stock.

9. A shotgun as in claim 8, wherein the shotgun is a semi-automatic shotgun.

10. A shotgun as in claim 8, wherein the carrier tube is parallel to the upper cavity.

11. A shotgun as in claim 8, wherein the shotgun is a pump shotgun, and the forearm stock is connected to the magazine of the pump shotgun.

12. A shotgun as recited in claim 8, wherein the accessory rail is selected from the group consisting of a picatinny rail, a weaver rail and a universal rail.

13. A shotgun as recited in claim 8, further comprising a set screw, adapted to secure the removable cover to the accessory rail.

14. A forearm stock for a shotgun, the forearm stock having at least one integral shot shell carrier tube for carrying shot shells for being dispensed and manually loaded by a user into a shotgun magazine or receiver, wherein said forearm stock comprises:

a forearm stock main body having an upper cavity for receiving a shotgun's tube magazine;

at least one internal carrier tube positioned below the upper cavity and adapted to receive a plurality of shot shells, said at least one carrier tube having an open end;

a mechanism for urging said shot shells out of said at least one carrier tube through said open end;

a retention mechanism adapted to retain said shot shells in said at least one carrier tube until a user manually disengages said retention mechanism;

an accessory rail, at a forward end of the main body; and a removable cover, adapted to cover the accessory rail.

* * * * *